US005102735A

United States Patent [19]

Shiojima et al.

[11] Patent Number: 5,102,735

[45] Date of Patent: Apr. 7, 1992

[54] LATENT LOOPED YARN, A FABRIC MADE OF THE SAME, AND A METHOD FOR MANUFACTURING THE LATENT LOOPED YARN

[75] Inventors: Minoru Shiojima, Ichinomiya; Toshiaki Miura, Nagoya; Keitarou Nabeshima, Otsu; Satoru Masuzaki, Nara, all of Japan

[73] Assignees: Toray Industries, Inc., Tokyo; Toray Textiles, Inc., Osaka, both of Japan

[21] Appl. No.: 224,313

[22] Filed: Jul. 26, 1988

[51] Int. Cl.[5] ..... D02G 3/00

[52] U.S. Cl. ..... 428/370; 428/399; 428/400; 428/257

[58] Field of Search ..... 428/370, 400, 369, 399

[56] References Cited

U.S. PATENT DOCUMENTS

| | | | |
|---|---|---|---|
| 2,962,794 | 12/1960 | Field, Jr. | 428/369 |
| 3,103,098 | 9/1963 | Dyer | 428/400 |
| 3,111,805 | 11/1963 | Boyer | 428/370 |
| 3,273,228 | 9/1966 | Bloch | 57/34 |
| 4,198,459 | 4/1980 | Brumlik | 428/224 |
| 4,245,001 | 1/1981 | Phillips et al. | 428/224 |
| 4,489,543 | 12/1984 | Bromley et al. | 57/208 |
| 4,519,200 | 5/1985 | Phillips | 57/246 |

FOREIGN PATENT DOCUMENTS

| | | | |
|---|---|---|---|
| 085438 | 11/1970 | Japan | 428/370 |
| 009357 | 1/1971 | Japan | 428/369 |
| 1027474 | 1/1971 | Japan | 428/369 |
| 1167109 | 10/1969 | United Kingdom | 428/370 |
| 2048329 | 12/1980 | United Kingdom . | |

*Primary Examiner*—George F. Lesmes
*Assistant Examiner*—Terrel Morris
*Attorney, Agent, or Firm*—Birch, Stewart, Kolasch & Birch

[57] ABSTRACT

This invention relates to a latent looped yarn having loops produced by an eddy current treatment and once potentialized therein before a weaving operation and revealed in a fabric, after the yarns are woven therein at least as warp yarns, by heat treatment, to give the fabric a spunlike handling and high yarn density. This invention also provides a manufacturing method for producing the latent looped yarn and high density spunlike fabrics utilizing the latent looped yarn.

3 Claims, 6 Drawing Sheets

▲ ---- BEFORE STRETCHING TREATMENT OF EXAMPLE 2 AND COMPARATIVE EXAMPLE

▲ —— BEFORE HEAT TREATMENT OF EXAMPLE 2 AND COMPARATIVE EXAMPLE

△ —— AFTER HEAT TREATMENT OF EXAMPLE 2 x —— AFTER HEAT TREATMENT OF COMPARATIVE EXAMPLE

● —— BEFORE HEAT TREATMENT OF EXAMPLE 1 o —— AFTER HEAT TREATMENT OF EXAMPLE 1

LATENT LOOPED YARN, A FABRIC MADE OF THE SAME, AND A METHOD FOR MANUFACTURING THE LATENT LOOPED YARN

BACKGROUND OF THE INVENTION

1. Field, of the invention

The present invention relates to a looped yarn which is produced in such a way that a running yarn is led into an area of an eddy current of a pressurized fluid to form opened loops and closed loops on a surface of the yarn in that area. In more detail, the present invention relates to a latent looped yarn and a method for manufacturing the same, in which opened loops and closed loops are previously provided on the yarn and the latent loops are revealed after the latent looped yarn is woven into a fabric,, and a method for manufacturing the same.

The present invention also relates to a high density fabric made of latent looped yarn and having a spunlike touch.

2. Description of the Related Arts

Various looped yarns in which many fine opened loops and closed loops are provided on each respective component filament of a multifilament are used, since such a looped yarn has a characteristic of giving a fabric a voluminous feeling and a certain stiffness.

But many operational problems arise when using such looped yarns in a weaving process to make a fabric; for example, the yarn is hooked at an abrasive contacting portion of a guide or tensor to create an abnormal tension on the yarn, and thereby cause yarn breakage, or the element thereof is destroyed when spun yarns are used in the same process.

There are many kinds of brown looped yarns in which a plurality of fine opened loops and closed loops are provided on each respective component filament of a multifilament, for making a spunlike fabric utilizing multifilament yarns, and there have been many proposals for making such a yarn, since a fabric having a voluminous feeling and a certain stiffness can be produced by such yarns.

These kinds of yarn inherently have a significant drawback such that, when a high tension exceeding a level of tension required is applied to the yarn, the loops are eliminated and thus the voluminous characteristic given tot he yarn is lost. Also, the voluminous characteristic disappears because the opened loops and closed loops thereof are formed on the surface of the yarn only by an entanglement among the component filaments.

Further, Japanese Patent Publication 61-40778 discloses a method for manufacturing a napped fabric utilizing an interlaced and mixed multifilament yarn having a two-layer configuration in which a filament yarn having a high shrinkage ratio is used as a core yarn and ultra fine fibers entangled around the core yarn are used as a sheath yarn, and a technology in which a fabric woven or knitted with the yarn receives a napping treatment.

Generally speaking, a looped yarn as mentioned above is used in most cases as a weft yarn when producing a spunlike fabric with the looped yarn, because of the problems mentioned above, and heretofore, there has never been a case in which such a looped yarn is used as warp yarn of a fabric.

But, if a high density fabric is to be produced utilizing multifilament yarns, it is not sufficient to use such a looped yarn only as a weft yarn thereof, and such a looped yarn should be also used as a warp yarn. Nevertheless, when such a looped yarn is used as warp yarn of a fabric, other drawbacks arise such that, for example, when used as a warp yarn of a fabric, the warp yarn density must be extremely coarse, because of the entanglement of the looped yarns with each other on a loom, which causes a problem of a lowered shedding ability during a weaving operation, as well as the operational problems described above.

To solve these problems, many attempts, such as attenuating the denier of filaments of a sheath yarn, have been made, but these require the use of several kinds of supplemental devices for taking the looped yarn from a yarn package.

But even when such a supplemental device is used, the warp yarn density is limited, and thus a fabric having high warp yarn density can not be obtained thereby.

On the other hand, in order to improve the yarn taking up operation from a yarn package and to improve the yarn passage ability in a weaving or knitting process or a preparing process for making a fabric arranged before or after the above weaving or knitting process, or due to the restrictions imposed because, when such a looped yarn is used as a warp yarn of a fabric, such loops must be especially eliminated or the fabric as a final product must be woven by using a yarn having a small number of loops produced in such a way that the yarns are not provided with loops at a high density and large size thereon in the first stage of the yarn production, while making a difference between the yarn length of the component filaments of the yarn extremely small, so that a fabric having a satisfactory feeling and surface touch can not be obtained. Accordingly, at present such a looped yarn can not be used as a warp yarn for making a fabric having a relatively high yarn density.

As is well known in this field, the number of the loops and the size thereof in a conventional looped yarn are seldom changed or are slightly increased, even if such a looped yarn is subjected to a hot water treatment with a subsequent free tension, and if such a looped yarn were used as a warp yarn, it would be impossible to obtain a fabric having a high yarn density and good spunlike feeling.

Therefore, to make a spunlike fabric having a high yarn density, a looped yarn which can be used as a warp yarn must be realized.

SUMMARY OF THE INVENTION

The object of the present invention is to overcome the technical drawbacks described above and to provide a new type of latent looped yarn which can be also used as a warp yarn of a high density fabric, and to provide a method for manufacturing the same.

In more detail, the present invention is intended to provide a latent looped yarn which can improve the yarn taking-up operation from a yarn package, which is one of the drawbacks in this technical field described above, enabling the yarn unwinding from the yarn package at a high yarn speed and, simultaneously, improving the condition in a weaving process or another yarn treating process or fabric treating process arranged before or after the weaving process. The latent looped yarn can also be used as a warp yarn to enable a fabric to be made that has a high density weaving construction, and further, can be used to make a spun like fabric having a superior feeling and surface touch in the final product thereof without applying a special treatment, such as a napping treatment, thereto.

Further, the object of the invention is to provide a spunlike fabric having a high density utilizing such a latent looped yarn, and a method for manufacturing the same.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

To attain the above-mentioned objects of the present invention, the latent looped yarn according to the present invention has a construction wherein a latent looped yarn consists of a mixed composite multifilament yarn comprising at least two synthetic multifilaments each having a different thermal shrinkage and having fine opened loops and closed loops on a surface thereof. The composite multifilament yarn has an ability such that, by receiving a thermal treatment while free of tension, in a multifilament yarn having a low thermal shrinkage ratio in boiling water, the total number of closed and opened loops and the size thereof can be increased compared with those retained in the multifilament yarn before heat treatment.

Figure 5:
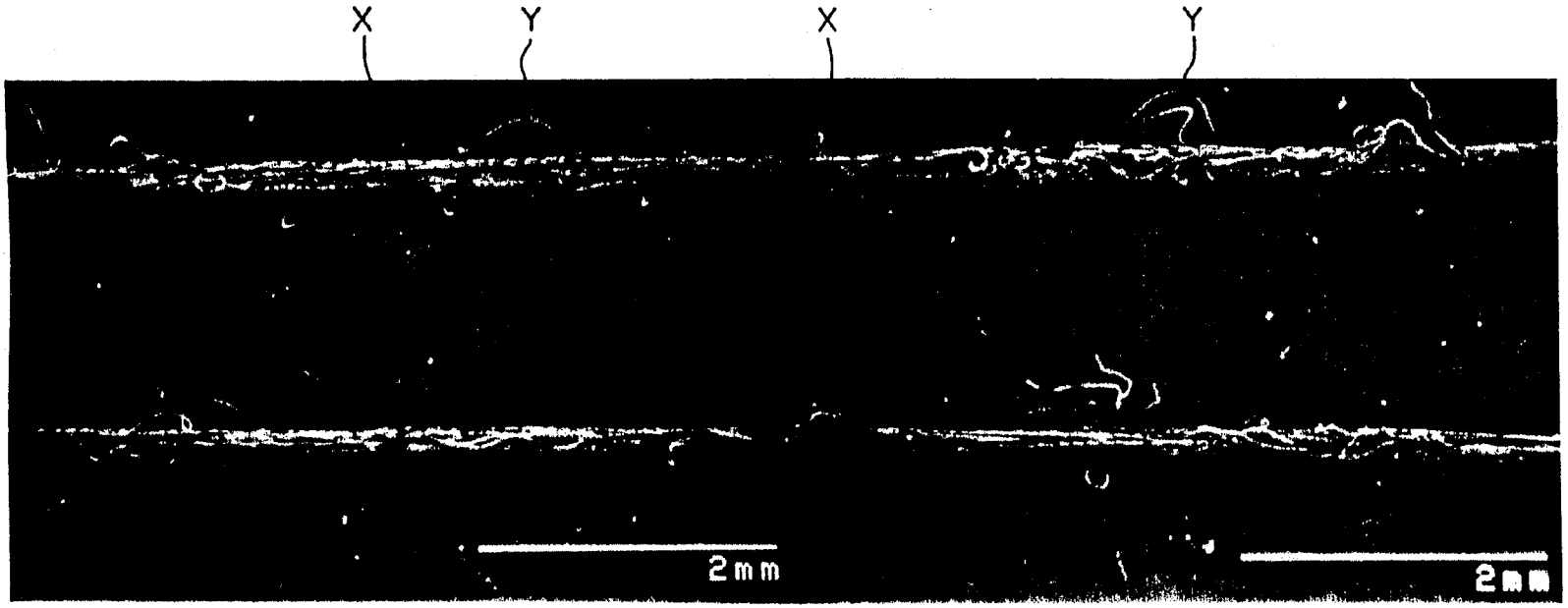
FIG. 5 shows latent looped yarn of the present invention obtained by stretching the looped yarn shown in FIG. 4.
Figure 6:
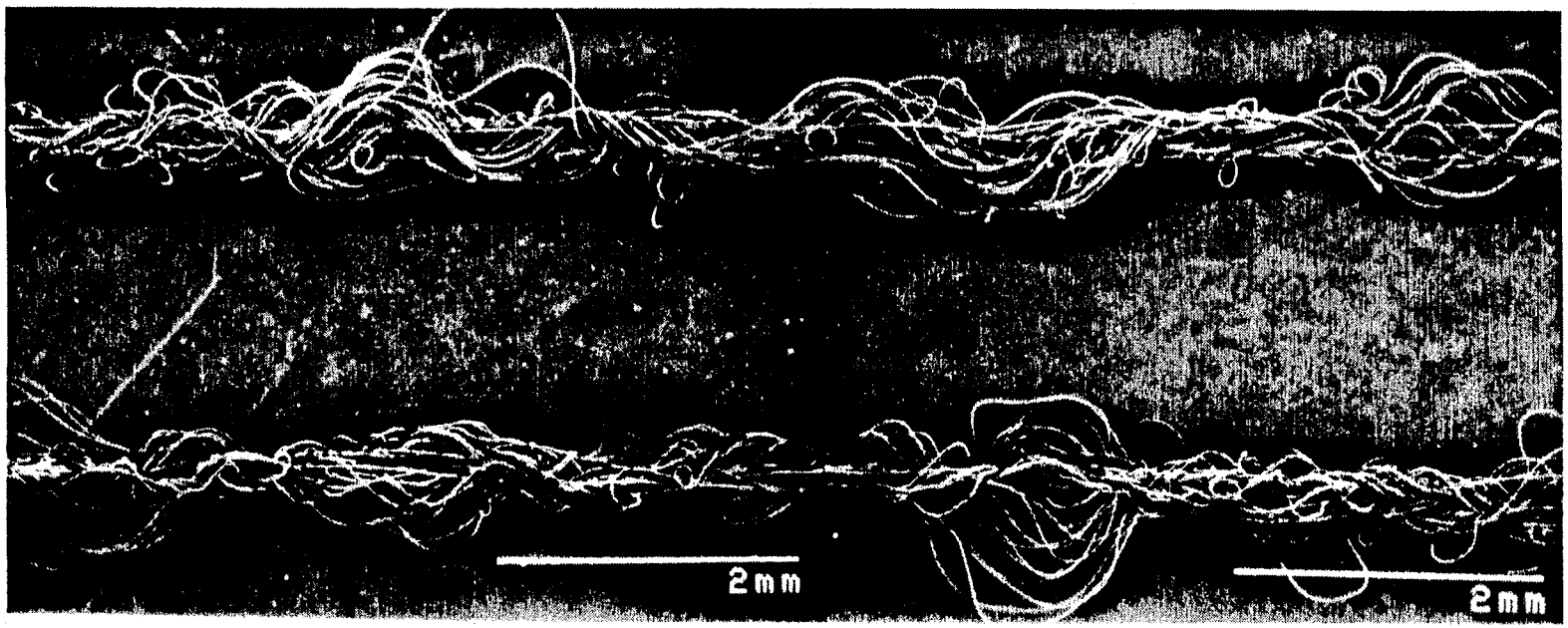
FIG. 6 shows bulked looped yarn obtained by heat-treating the looped yarn shown in FIG. 4 with hot water at 98° C. under shrink free conditions; and, FIG. 7 shows looped yarn of the present invention after developing latent loops on the surface thereof by heat-treating the latent looped yarn shown in FIG. 5 with hot water at 98° C. under shrink free conditions.

In the present invention, the closed loop is a loop in which the root portion is closed as shown by X in FIG. 5, and the opened loop is a loop in which the root portion is opened, as shown by Y in FIG. 5.

Further, in the present invention, the looped yarn is characterized in that, in accordance with the classification of the loops as defined hereunder, the total number of the respective fine opened loops and closed loops provided on the surface of the latent looped yarn before receiving a heat treatment such as, for example, a hot water treatment under free tension, is such that loop A, loop B and loop C has more than 300 ends/m, more than 50 ends/m, and less than 10 ends/m, respectively.

Each of said loop A, loop B and loop C is defined in such a manner that, when each loop is measured under the conditions of a yarn speed of 50 m/min and a yarn running tension of 0.1 g/d, by using a photo-electric type fluff measuring device (for example, a fluff counter sold by TORAY Industries Inc. under the name of "TORAY FRAY COUNTER") which counts the number of loops of a yarn running therethrough, a loop projecting more than 0.15 mm from a yarn surface is defined as a loop A, a loop projecting more than 0.35 mm from a yarn surface is defined as a loop B, and a loop projecting more than 0.6 mm from a yarn surface is defined as a loop C.

Further, the latent looped yarn is characterized in that a strong loop revealing force is retained inside thereof in this condition. Note, preferably that the looped yarn has a loop revealing force in which the number of loops B is increased by more than 1.5 times that of the yarn and the number of loops C is increased to more than 50 ends/m after the yarn is subjected to thermal treatment with hot water at 98° C. for ten minutes under a shrink free condition and then dried.

The latent looped yarn according to the present invention will be now explained in more detail.

The latent looped yarn of the present invention is a composite yarn which comprises basically a multifilament having a high shrinkage ratio and a multifilament yarn having a low shrinkage ratio, and both multifilament yarns may be arranged in a side by side configuration in which both multifilaments are arranged in parallel to each other along the yarn axis thereof, or may be arranged in a sheath and core configuration, in the latent looped yarn.

In the latter case, the multifilament having a high shrinkage ratio is preferably arranged in a core portion of the latent looped yarn and the multifilament having a low shrinkage ratio or normal shrinkage ratio is preferably arranged in a sheath portion thereof.

In the present invention, the latent looped yarn may be made by interlacing the multifilament yarns, with each other.

The number and size of the fine opened loops and closed loops provided on the surface of the latent looped yarn of the present invention is small, and the value of a voluminosity of the yarn is relatively small, as shown in FIG. 5.

A feature of the present invention is that the number of opened loops and closed loops projecting more than 0.6 mm from the surface of the looped yarn, i.e., loops C, is less than 10 ends/m, which is remarkably small and can be considered negligible.

Figure 4:
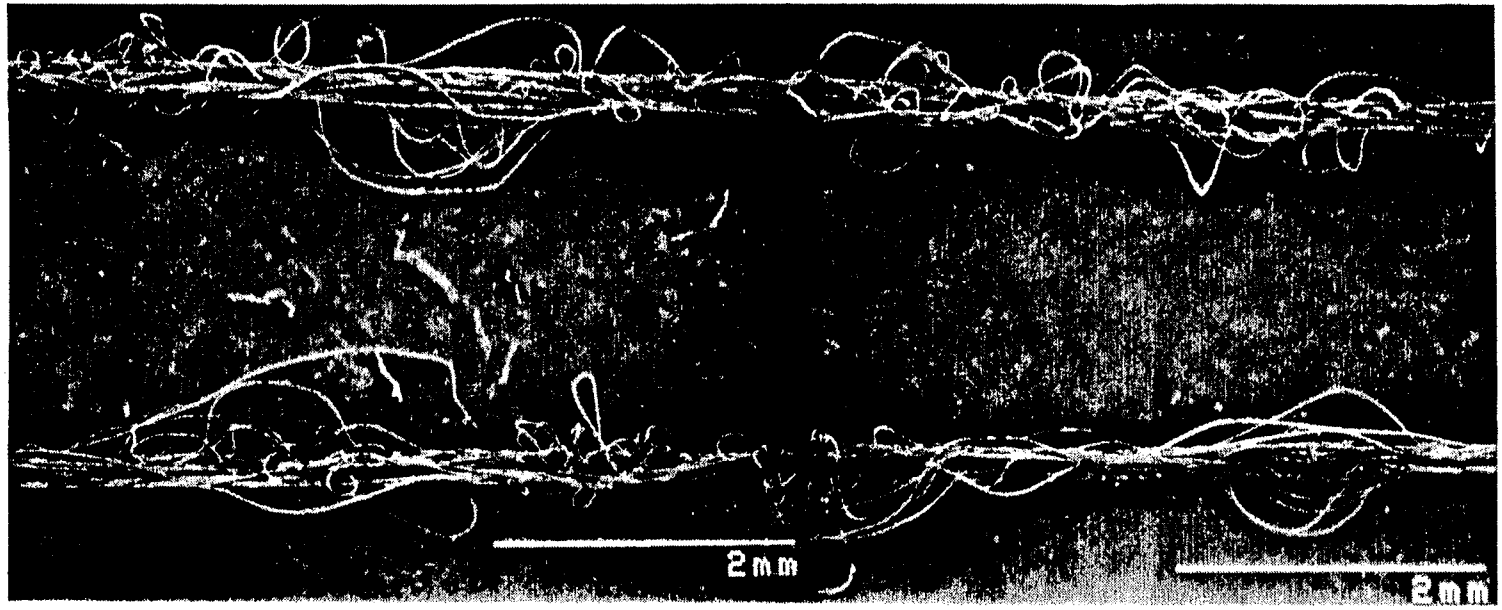
FIG. 4 shows looped yarn produced by an eddy current treatment with compressed air, as obtained in Example 5.
Figure 7:
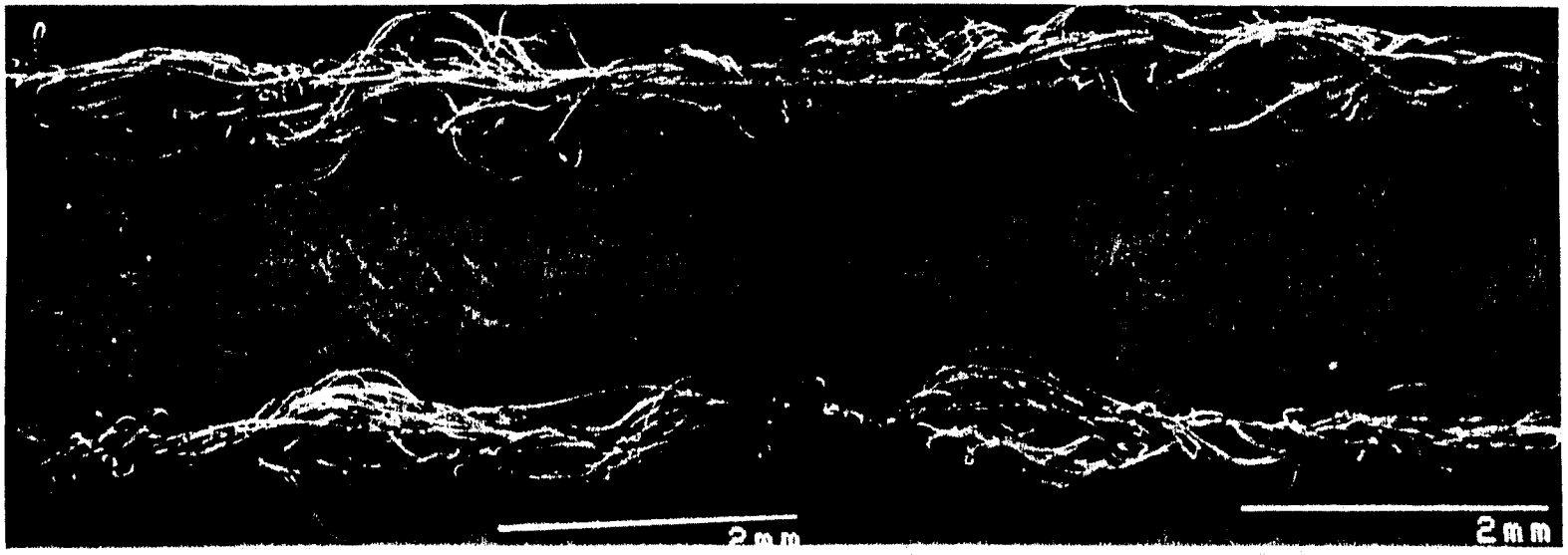

Namely, the latent looped yarn of the present invention does not have an outer surface configuration of a bulky yarn in a condition just after the yarn is textured as a mixed composite multifilament yarn in the eddy current zone with the pressurized air, as shown in FIG. 4. But when this latent looped yarn is treated with heat in hot water at 98° C. under free tension for 10 minutes, the latent looped yarn, per se, is caused to shrink by the shrinkage of the multifilament yarns having a high shrinkage ratio and a low shrinkage ratio, as shown in FIG. 7.

As the multifilament yarn having a high shrinkage ratio and the multifilament having a low shrinkage ratio are interlaced with each other, and as already known, the shrinkage of each component filament of a multifilament having a low shrinkage ratio is less than that of each component filament of a multifilament yarn having a high shrinkage ratio, when such a latent looped yarn, per se, is shrunk, each component filament of the multifilament yarn having a low shrinkage ratio is protected from the surface of the yarn to form opened loops and closed loops by the shrinkage of the multifilament yarn having a high shrinkage ratio, which reduces the latent looped yarn into a looped yarn having revealed loops thereon and having a voluminosity.

The looped yarn having opened loops and closed loops revealed by the heat treatment has a remarkably increased voluminosity in which the number of loops B projected more than 0.35 mm from a yarn surface is increased by more than 1.5 times that of the composite yarn before heat treatment, and the number of loops C projected more than 0.6 mm from a yarn surface is increased to more than 50 ends/m after the composite yarn is subjected to a thermal treatment with hot water at 98° C. for ten minutes under a shrink free condition, and dried.

As described above, the latent looped yarn of the present invention has the latent opened loops and closed loops therein when it is produced, and the number of loops C projecting from the surface of the yarn is extremely small.

Accordingly, the bulkiness, per se, of this yarn is very low, and the surface of the yarn is comparatively smooth; as shown in FIG. 5, and therefore, the yarn running friction thereof or a device provided for this process is very small.

Especially, when this yarn is used as a warp yarn of a fabric, the running ability of the yarn in the head and the reed is excellent, and there is no possibility of an entanglement of the loops of adjacent warps with each other, or an incomplete shedding at a loom. Therefore, this yarn can be used as a warp of the fabric.

Further, when a dying and finishing treatment is applied to the fabric after the weaving process, a high density and high bulk fabric can be obtained by subjecting the fabric to a heat treatment (utilizing dry heat, wet heat or steam heat, for example) at a high temperature in a tension free condition alone, or accompanied by a dying treatment, causing the latent opened loops and closed loops of the latent looped yarn to be revealed.

To attain another object according to the present invention of manufacturing the latent looped yarn, at least two synthetic multifilaments each having a different shrinkage ratio are simultaneously fed into an eddy current zone to make the opened loops and closed loops on the surface of the yarn, and thereafter, the yarn is stretched to eliminate or refine the loops.

In the process mentioned above, a shrinkage ratio in hot water of the multifilament yarn having a high shrinkage ratio may be more than 10%, and the difference in the shrinkage ratio in hot water between the multifilament yarn having a low shrinkage ratio may be more than 5%.

Further, a denier of a component filament of the multifilament yarn having a low shrinkage ratio may be 0.05–2.5d, preferably 0.05–1.3 denier, and a denier of a component filament of the multifilament yarn having a high shrinkage ratio may be 0.1–15 denier, preferably 0.3–15 denier and more preferably 1–15 denier.

A preferred embodiment of the process for making a latent looped yarn of the present is invention will be now explained with reference to FIG. 1, as an example.

Figure 1:
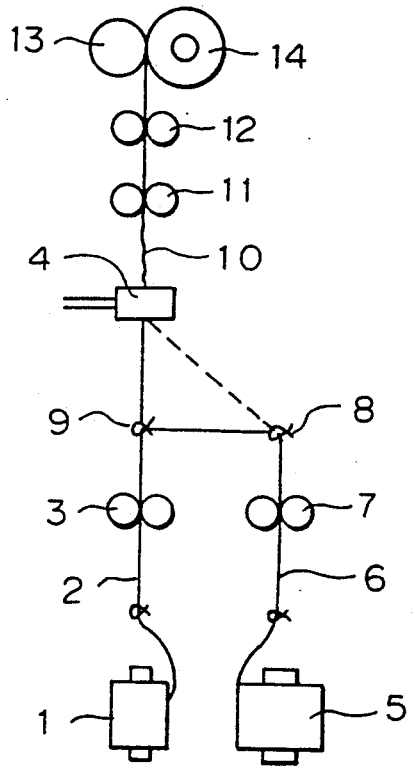
FIG. 1 is a schematic view of one embodiment of yarn making process of latent looped yarn of the invention.

FIG. 1 is a schematic view of one embodiment of the process for making a latent looped yarn of the present invention.

As shown in FIG. 1, a high shrinkage multifilament yarn 2 unwinding from a package 1 is supplied to a texturing device 4 at which an eddy current zone is formed by compressed air, through feed rollers 3. At the same time, a low shrinkage multifilament yarn 6 unwinding from a package 5 is fed to the same texturing device 4 through feed roller 7. These multifilaments 2 and 6 are simultaneously fed to the texturing device 4 through suitable yarn guides 8 and 9.

Note, in this process, the multifilament yarn 6 can be fed directly to the texturing device 4.

After the multifilament yarns 2 and 6 have passed through the texturing device 4, which provides an eddy current of a compressed air, they are wound onto a package 14 as a looped yarn 10, through a first take up roller 11, a second take up roller 12, and a winding device 13.

During this process, the looped yarn thus produced is stretched between the taking up roller 11 and 12. This stretching operation is used to eliminate the large opened loops and closed loops of the looped yarn, and preferably is controlled so that it does not affect the development of the opened loops and closed loops during the heat treatment. Namely, if the stretch is too weak the opened loops and closed loops are properly eliminated and when the stretch is too strong, the fine opened loops and closed loops of the looped yarn formed by the eddy current zone are almost completely extinguished.

Preferably, the elimination of the loops is carried out in such a way that the fine loops cannot be seen on the surface of the yarn by the naked eye but only by utilizing a microscope or a magnifying glass.

The latent looped yarn of the present invention is preferably produced under the following conditions.

Namely, in the process of the present invention, a multifilament yarn having a shrinkage ratio in hot water of more than 10% and having a filament denier of 0.1–15d, preferably 0.3–15d and more preferably 1–15d is used as a high shrinkage yarn, and a multifilament having a shrinkage in hot water such that the difference in the shrinkage between the multifilament yarn having a high shrinkage ratio and that of the multifilament yarn having a low shrinkage ratio is more than 5% and having a filament denier of 0.05–2.5d preferably 0.05–1.3d, is used as a low shrinkage yarn.

These yarns are supplied to the texturing device 4 which provides the eddy current zone with a compressed air (in which a feed volume of the compressed air is 80–120 ml/min), from the respective feed rollers, at a different overfeed ratio, and after the yarn is withdrawn from the texturing device, the looped yarns, which have been interlaced and mixed treatment, are taken up by the same taking up roller.

The overfeed ratio used in the present invention is based on the following equation, $$F(\%)=(V_1-V_2)/V_2\times 100$$

wherein, $V_1$ represents a surface speed of the feed roller and $V_2$ represents a surface speed of the taking up roller.

Note, the overfeed ratio of the present invention is defined only when the F value obtained from the equation is positive (+).

In the present invention, the overfeed ratio $\lambda$ of the high shrinkage multifilament yarn is set at around 2–15% and the overfeed ratio $\beta$ of the low shrinkage multifilament is set at around 5–30%. Further, more preferably, in the present invention the yarn withdrawn from the first taking up roller is taken up by the second taking up roller under a continuous stretching condition at an underfeed ratio of 0.4λ–0.8λ to the overfeed ratio λ of the high shrinkage yarn.

In the present invention, a multifilament yarn having a filament denier of 0.1–15d is used as the high shrinkage yarn of the latent looped yarn. Namely, when the filament denier is less than 1d, the desired yarn shrinkage cannot generally be obtained after the heat treatment, because the shrinkage of the filaments is small and shrinkage ratio of the yarn is substantially reduced but however, even when a filament having a denier thereof of less than 1.0d is used, a sufficient yarn shrinkage can be obtained in the case of the content thereof being more than 40 weight % of said the filament denier is more than 15d, the fabric obtained has a coarse feeling and experiences deteriorated handling because the yarn, per se, has a high hardness.

Preferably the shrinkage of the high shrinkage multifilament yarn is large, even though the use of a yarn having a large shrinkage causes other problems in that such a yarn has an inherent instability in its size thereof and a variation with an elapse of time, and thus the quality of a product made with this yarn may not be stable. Accordingly, preferably a multifilament yarn having a shrinkage of from 10 to 30 is used.

On the other hand, a multifilament yarn having a filament denier of 0.05–1.3d is preferably used as the low shrinkage multifilament yarn.

Note, a multifilament having a filament denier of less than 0.05d may be used, but when the denier becomes very small the yarn handling will become difficult because of the development of fluffs, and when a filament denier thereof exceeds 1.3d, it is difficult for the fine loops to be revealed and a fabric obtained from such a yarn will have a coarse handling.

Note, the shrinkage of the low shrinkage multifilament, is preferably as low as possible, but since special yarns generally have problems of yarn texturing ability and dying, preferably a multifilament yarn having a normal shrinkage (a shrinkage ratio ΔS of around 7.5%) is used.

Namely, the difference between the shrinkage ratio of the high shrinkage multifilament yarn and the shrinkage ratio of the low shrinkage multifilament must be at least 5%, because the development of the opened loops and closed loops of the latent looped yarn depends completely upon such a difference in the shrinkage ratios.

When making the latent looped yarn of the present invention, the overfeed ratio λ of the high shrinkage multifilament yarn is preferably 2–15% and the overfeed ratio β of the low shrinkage multifilament is preferably 5–30%, and further, the difference between the overfeed ratios β–λ are preferably 3–15%. These conditions are most suitable for forming the fine opened loops and closed loops in said the current zone with a compressed air.

The latent looped yarn obtained in the present invention is a mixed composite yarn made of synthetic multifilament yarns each having a different shrinkage and having fine opened loops and closed loops on the surface thereof and the number and the size thereof can be increased by heat treatment under a free tension or shrink free condition.

Namely, the yarn of the present invention must not have an outer configuration as a bulky yarn at the stage in which the yarn is textured as a mixed composite multifilament yarn by entanglement just after passing through the eddy current zone. But, as described above, when the latent looped yarn is treated by a thermal treatment with hot water at 98° C. for ten minutes under a shrink free condition and dried, many opened loops and closed loops are projected and revealed on the surface of the yarn.

EXAMPLE

By using the yarn manufacturing method as shown in FIG. 1, a latent looped yarn was produced under the condition wherein the overfeed ratio λ of a high shrinkage multifilament yarn and the overfeed ratio β of a low shrinkage multifilament were set at 9% and 15%, respectively, and a "TASTAN" type nozzle was used as a texturing device 4 with an air feed volume of 90 N 1/mi and further, the underfeed ratio between the first taking up roller and the second taking up roller was set at 5.4% (i.e., 0.6λ).

The combinations of the high shrinkage multifilament yarn and the low shrinkage multifilament yarn used are as shown below:

EXAMPLE 1

High shrinkage yarn: Polyester multifilament 50D −24F (having a high shrinkage ratio of ΔS =20%)

Low shrinkage yarn: Polyester multifilament 50D −72F (having a normal shrinkage of ΔS =7.5%)

EXAMPLE 2

High shrinkage yarn: Polyester multifilament 30D −12F (having a high shrinkage ratio of ΔS =20%)

Low shrinkage yarn: Polyester multifilament 30D −48F (having a normal shrinkage of ΔS =7.5%)

COMPARATIVE EXAMPLE

High shrinkage yarn: Polyester multifilament 30D −12F (having a normal shrinkage of ΔS =7.5%)

Low shrinkage yarn: Polyester multifilament 30D −48F (having a normal shrinkage of ΔS =7.5%)

The yarn shrinkage of the latent looped yarn thus obtained, and the characteristics of the loops before and after the treatment are disclosed in Table 1.

TABLE 1

| | | Example 1 | Example 2 | Comparative Example |
|---|---|---|---|---|
| Yarn shrinkage (%) | | 17.8 | 18.4 | 7.1 |
| Before | loop A | 447 | 332 | 332 |
| heat | loop B | 125 | 72 | 68 |
| treatment | loop C | 1 | 1 | 1 |
| After | loop A | 438 | 416 | 363 |
| heat | loop B | 390 | 330 | 115 |
| treatment | loop C | 168 | 88 | 11 |
| Before | loop A | | 345 | 340 |
| stretching | loop B | | 101 | 96 |
| treatment | loop C | | 13 | 12 |

In Table 1, the yarn indicated as "before the heat treatment" is the latent looped yarn of the invention, per se, and the yarn indicated as "after the heat treatment" is the looped yarn obtained from the latent looped yarn in such a way that the latent looped yarn was wound 100 times on a reel having a reel length of 1 m to make a short hank and then the short hank was immersed in hot water at 98° C. for 10 minutes under a shrink free condition, and thereafter, dried.

Further, the yarn indicated as "before the stretching treatment" is a yarn produced by winding up the latent looped yarn withdrawn from the first taking up roller, without a stretching operation.

Figure 2:
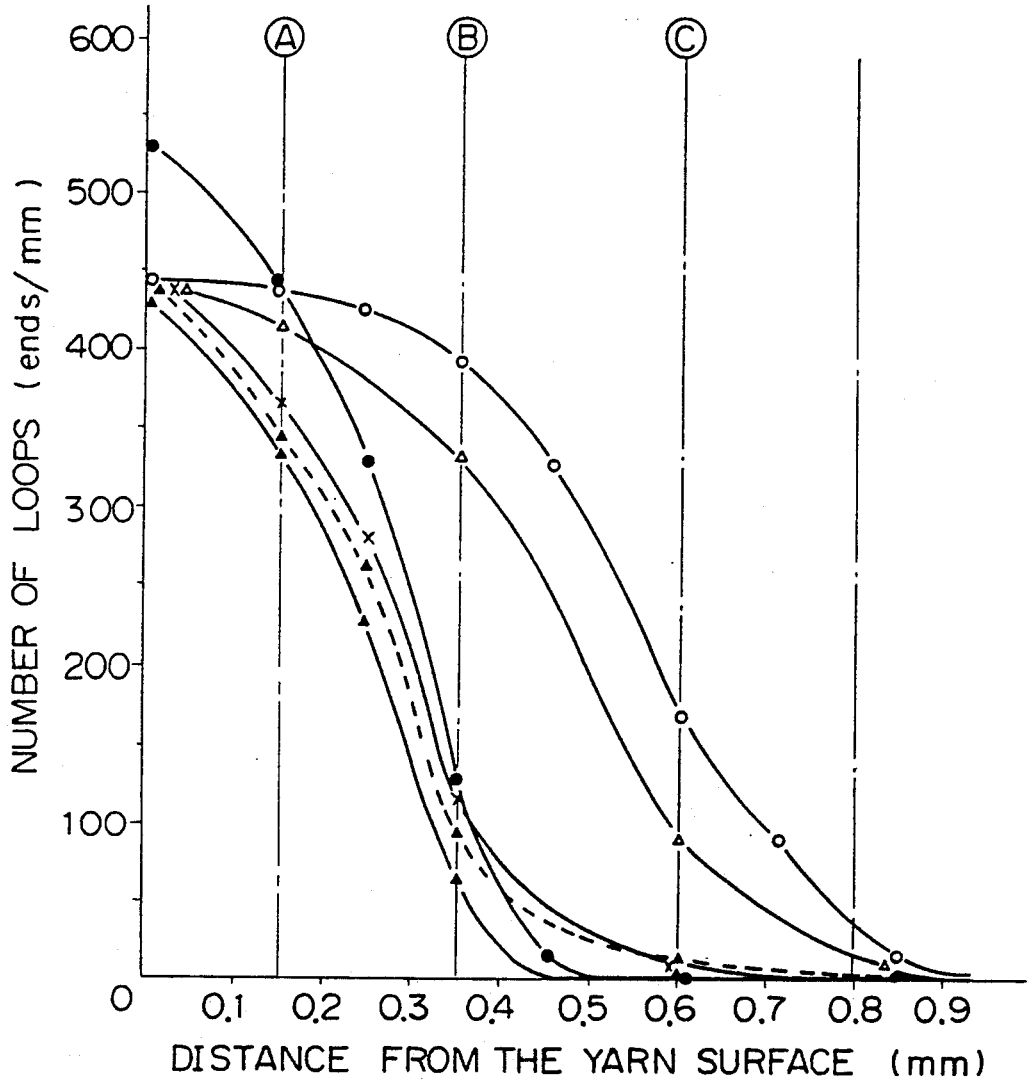
FIG. 2 is a graph indicating the results obtained in the examples 1 and 2 in the invention.

FIG. 2 is a graph indicating the results of the data shown in the Table 1.

The characteristics of the loops of the Examples were measured by the following method.

Namely, the yarn to be measured was passed through a photo-electric type fluff measuring device (for example, a "TORAY FRAY COUNTER") under the conditions of a yarn speed of 50 m/min and a yarn running tension of 0.1 g/d, to count the number of loops on the yarn, and this counted number thereof was indicated as a value per meter based upon the measured data obtained in 20 seconds (n=5).

On the other hand, for the measurement of the yarn after the treatment, the sample for measurement was produced in such a way that after the short hank was dried by air, it was mounted on a reel by hand, while ensuring that no tension was given to the yarn, and thereafter, was wound on a bobbin by slowly rotating the reel.

As apparent from FIG. 2 and Table 1, the number of loops C on the latent looped yarn in the Example of the present invention is comparatively small, and although in the yarn before the stretching treatment, a small number of loops C can be seen, these loops C are completely eliminated to produce a condition wherein no loops exist on the yarn.

Related to the characteristics of the loops of the yarn after the treatment, the loops B and C are remarkably increased in Example 1 and 2, but conversely, the increment of the loops B and C in the comparative example is extremely small.

By comparing the results of Example 2 with that of the comparative Example, the number of loops B after the treatment is steeply increased by nearly 5 fold of that of the number of loops B before the treatment, and the number of loops C after the treatment is also steeply increased up to 88 ends/m in the former case, but in the latter case, the increment of the number of loops B after the treatment is only 1.5 times that of the number before the treatment, which is deemed to be small, and the number of loops C after the treatment is 11 ends/m, and there is no increment thereof.

Although the variations of the characteristics of the loop both before and after the stretching treatment were also considered, there were no significant differences there between, and thus only the data related to If the number of loops B after the treatment is not increased more than 1.5 times that of the number before the treatment, and the number of loops C is not more than 50 ends/m, the thus obtained looped yarn is not preferable because of a very low bulkiness and a coarse touch feeling thereof.

It can be seen that the characteristics of the loops of the looped yarn depend upon the shrinkage ratio of the latent looped yarn and the difference between the shrinkage ratio of the high shrinkage yarn and the low shrinkage yarn. Namely, in the comparative Example, there is no difference in the shrinkage ratio of the two yarns, and accordingly, the variation of the characteristics of the loops before and after the treatment is very small, and there is little difference between the loops on the yarn formed in the eddy current zone and those on the yarn after the treatment.

In comparison, the characteristics of the loops of the yarn already treated by the heat treatment obtained in the Examples can be remarkably increased, because the shrinkage difference between the high shrinkage yarn and the low shrinkage yarn is large, and further, the high shrinkage yarn has a large shrinkage ratio, and these factors have a synergetic effect on the yarn.

EXAMPLE 3

In the process as shown in FIG. 1, a polyester multifilament yarn, 75D-36F, having a shrinkage ratio in hot water of 15%, and consisting of 18 ends of filaments having a shrinkage ratio in hot water of 20% as high shrinkage components and 18 ends of filaments having a shrinkage ratio in hot water of 8% as low shrinkage components, was used as a core yarn, and a polyester multifilament yarn, 75D-96F, having a shrinkage ratio in hot water of 8% was used as a sheath yarn, and these yarns were supplied to texturing zone provided with a "TASLAN" nozzle at an overfeed ratio of the core yarn of +9% and an overfeed ratio of the sheath yarn of +20%, and were treated by a texturizing treatment under a high pressure of 8.0 kg/cm$^2$.

Subsequently, the thus treated yarn was wound up on a package, while being stretched between the first taking up roller and the second taking up roller, at an underfeed ratio of −6.5%.

The yarn characteristics thus obtained are as follows.

| | |
|---|---|
| Shrinkage ratio of the yarn | 14.2% |
| Number of loops at the initial stage of the texturing process | |
| LOOP A | 428 ends/m |
| LOOP B | 360 ends/m |
| LOOP C | 15 ends/m |
| Number of loops after the eliminating treatment | |
| LOOP A | 317 ends/m |
| LOOP B | 78 ends/m |
| LOOP C | 3 ends/m |
| Number of loops after the recovery treatment | |
| LOOP A | 395 ends/m |
| LOOP B | 320 ends/m |
| LOOP C | 45 ends/m |

The data of the number of loops after the recovery treatment is a conversion data in which the raw data thereof is modified by the shrinkage element. Also, in the data of the number of loops after the recovery treatment, the number of loops C is higher than that of the same loop measured at the initial stage of the texturing process. This is because a loosened or sagged portion of the filament created by the yarn shrinkage is counted in addition to the recovered loops.

EXAMPLE 4

In the process as shown in FIG. 1, a polyester multifilament yarn, 75D-36F, having a shrinkage ratio in hot water of 20% was used as a core yarn and a polyester multifilament yarn, 75D-96F, having a shrinkage ratio in hot water of 10% was used as a sheath yarn, and these yarns were supplied to texturing zone provided with a "TASLAN" nozzle at an overfeed ratio of the core yarn of +12% and an overfeed ratio of the sheath yarn of +20%, and were treated by a texturizing treatment under a high pressure of 6.0 kg/cm$^2$.

Subsequently, the thus treated yarn was wound up on a package while being stretched between the first taking up roller and the second taking up roller, at an underfeed ratio of −3.0%.

The yarn characteristics thus obtained are as follows.

| | |
|---|---|
| Shrinkage ratio of the yarn | 10.4% |
| Number of loops at the initial stage of the texturing process | |
| LOOP A | 620 ends/m |
| LOOP B | 430 ends/m |
| LOOP C | 165 ends/m |
| Number of loops after the eliminating treatment | |
| LOOP A | 546 ends/m |
| LOOP B | 175 ends/m |
| LOOP C | 4 ends/m |
| Number of loops after the recovery treatment | |
| LOOP A | 573 ends/m |
| LOOP B | 397 ends/m |
| LOOP C | 182 ends/m |
| Bulkiness of the yarn ($cm^3/g$) | |
| At the initial stage of the texturing process | 17.5 |
| After the eliminating treatment | 4.51 |
| After the recovery treatment | 19.49 |
| Increment of the bulkiness (%) | 432 |

The measurement of the bulkiness was carried out by using the method defined in Japanese Industrial Standard (JIS) L 1059C.

The latent looped yarn obtained in this invention has a greatly improved yarn unwinding characteristic from a yarn package and has a superior yarn unwinding characteristic at a high yarn speed.

In this invention, an extremely wide range of the thermoplastic synthetic filaments can be used regardless of any restrictions on the filament denier or a cross sectional shape of a component yarn of the sheath yarn, for example.

Furthermore, when the latent looped yarn of this invention is used as a warp yarn of the fabric, the running ability of the yarn in the head and the reed is excellent and there is no possibility of entanglement of the loops of adjacent warps with each other, or an incomplete shedding at a loom.

Consequently, a fabric having a high yarn density can be produced when such a looped yarn is used as a warp yarn.

Furthermore, in this invention, a relaxed heat treatment can be applied to the fabric after the weaving process without tension and all of the latent looped yarn can perform the recovery motion to regain the loop shape formed at the initial stage of the texturing process.

Therefore, a remarkable fabric having various kinds of feeling or surface touch can be obtained depending upon the method and condition of the relaxed heat treatment.

Further, the latent looped yarn of this invention is a mixed composite multifilament yarn having opened loops and closed loops projected on the surface thereof, and although the number of large sized loops classified into group C is very small, it has a superior characteristic such that, when subjected to a heat treatment, the number of large sized loops classified as loops B and C can be remarkably increased, and therefore, the weaving operation can be performed with a high efficiency.

Furthermore, in this invention, the fabric obtained can possess a soft handling because a fabric having a high density can be made through the shrinkage operation by the heat treatment carried out after the weaving operation, whereby a large number of the opened loops and closed loops can be revealed on the surface of the fabric.

In a conventional looped yarn, it has been necessary reveal as many as possible opened loops and closed loops on the surface thereof, to a fabric having a good feeling and handling effects after the dying and finishing treatment, but when a yarn having many opened loops and closed loops is used as a warp yarn, the weaving operation has many problems, as mentioned above.

Accordingly, in the conventional manner of using such a looped yarn as a warp yarn, the yarn density must be reduced or the number of opened loops and closed loops must be reduced, to maintain the weaving efficiency at the mass production level. But this reduction of the opened loops and closed loops causes degradation of the feeling or surface touch of the fabric.

According to the present invention, the weaving efficiency of the looped yarn having a minimum loop level by which a fabric having a good spunlike handling is obtained, is such that the loom stopping counts indicated per 24 hours per loom was 24.1 counts/24 hr loom, as indicated in Table 2, and this is a bad result compared with the standard level of 10 counts/24 hr loom required for mass production.

The fabric obtained in such a bad condition had no value for final products, and accordingly, these kind of the fabrics have never been sold in any market.

Contrary to this, the latent looped yarn of this invention can have a remarkable effect on the weaving ability, such as 4.3 counts/24 hr loom as shown in Table 2.

In this invention, the number of opened loops and closed loops can be adjusted to any desired level merely by changing the difference in the shrinkage ratio of the core yarn and the sheath yarn, the shrinkage ratio of the core yarn and the overfeed ratio of both the core yarn and the sheath yarn.

Accordingly, in this invention, many superior functions and effects such a widening of the capability of designing fabrics, can be obtained.

TABLE 2

| | warp yarn | 70D - 48F Conventional looped yarn | 70D - 60F Latent looped yarn |
|---|---|---|---|
| Loop characteristic | loop A (ends/m) | 460 | 524 |
| | loop B (ends/m) | 170 | 126 |
| | loop C (ends/m) | 15 | 3 |
| Weaving ability | loom stopping count (count/24 hr loom) | 24.1 | 4.3 |
| Weaving conditions | Weaving construction | Plane | |
| | Weaving density (warp × weft) | 132 × 93 | |
| | loom · revolution number | WJL NISSAN LW-41 Type 400 rpm | |
| | Weft yarn | 70D - 60F latent loop yarn | |

*Loop stopping count caused by warp yarns

Next, spunlike fabrics having a high yarn density produced by using the latent looped yarn of the present invention mainly as warp yarns are described as follows.

As described above, the method of manufacturing a fabric having a spunlike handling, utilizing a looped yarn consisting of multifilament yarns having many opened loops and closed loops on the surface thereof formed by, for example, the "TASLAN" process, is already But such a yarn can be used only as a weft yarn of he fabric, and there is a strict limitation on the use of such a yarn as warp yarns of the fabric, because of a difficult yarn handling and poor yarn passing ability in the weaving process.

In this invention, by using the latent looped yarn, all of the drawbacks mentioned above can be overcome and a high density fabric having a soft and spunlike feeling, wherein a mixed composite multifilament yarn having opened loops and closed loops is used as the warp yarns, can be obtained.

According to the invention, the spunlike fabric utilizing a latent looped yarn has a construction such that a high density fabric, in which a mixed composite multifilament yarn consisting of synthetic multifilaments having opened loops and closed loops on a surface thereof, is used at least as the warp yarns of the fabric, and a cover factor of the warp yarns of the fabric is more than 1100.

In this fabric, preferably the latent looped yarn used as a warp yarn is a mixed composite multifilament yarn comprising at least two multifilaments each having a different shrinkage factor.

The fabric of the present invention will be now described more detail.

By using the latent looped yarn consisting of synthetic multifilament yarns having opened loops and closed loops, as the warp yarns, the opened loops and closed loops exist in a mixed state on the surface of the fabric, and such loops provided on the surface of the fabric give the fabric a soft handling touch which is the same as the fluff of the spun yarn, and simultaneously, an unevenness feeling like a fabric made of a spun yarn, because the arrangements of the multifilament yarns consisting of both the warp yarns and the weft yarns are out of order, from the visual point of view.

Note, the smaller the denier of a component filament, the better the spun like feeling of the fabric.

Further, in this invention, the fabric must be reduced to a fabric having a high density, to provide a soft and spunlike feeling and handling of the fabric, by the opened loops and closed loops existing in a mixed state on the surface of the fabric utilizing the latent looped yarn, and for giving the fabric a suitable stiffness and avoiding the problems of a fastening effect caused by the loops or dust accumulation.

Therefore, in the fabric of this invention, the yarn density of the warp yarn must be set in such a way that the cover factor of the mixed composite multifilament yarn having opened loops and closed loops used as warp yarns in the fabric already treated by a dying and finishing treatment is more than 1100, and preferably less than 1600.

Generally speaking, if the cover factor of the warp yarn is more than 1100, as mentioned above, when a weaving operation is carried out by using such a mixed composite multifilament yarn having opened loops and closed loops, such loops provided on each adjacent warp are entangled with each other by repeated mutual contact therebetween caused by the shedding operation of the loom, and thus problems such as an incomplete shedding or picking will arise, and therefore, a fabric having a good quality can not be produced at a mass production level.

In this invention, contrary to the conventional looped yarn, the latent looped yarn is used to improve the yarn passage ability in the weaving process, and thus a fabric having a relatively high yarn density, compared with a fabric made of the conventional looped yarn, can be woven, and further, this fabric can be reduced to a fabric having a higher yarn density by shrinking by a heat treatment under a shrink free condition, such as a relaxed treatment in the dyeing and finishing treatment.

Namely, in this invention, a high density fabric can be produced even when a mixed composite multifilament yarn having opened loops and closed loops thereon is used as the warp yarns.

The fabric of the present invention has milder surface characteristic, compared with a fabric made of the conventional looped yarn produced by a eddy current treatment, because the loops which are potentialized in the yarn are revealed in the fabric by a loop developing treatment, and thus the number of loops revealed on the cross point of the warp and weft yarn is very small.

As already known, the feel or handling of a fabric mainly depends upon the effect of a warp yarn in a general fabric having a normal weaving construction, although when the latent looped yarn which is the same yarn as used for the warp yarn is used for the weft yarn, a high yarn density fabric utilizing the looped yarn as both the warp and weft yarns can be obtained, and the handling thereof and a spunlike and soft feeling of the surface thereof is far superior to that of a fabric made of the looped yarn produced by the eddy current treatment and used as the weft yarns.

Moreover, as the weft yarn used in this invention, the mixed composite multifilament yarn consisting of synthetic multifilament yarns comprises at least two synthetic multifilaments each having a different shrinkage ratio and having a total shrinkage ratio in hot water of more than 10%, or a yarn having a low shrinkage ratio in hot water but having a shrinkage ratio in dry heat of more than 10%, or even a mixed spun yarn comprising staple fibers each having a different shrinkage, can be used.

As the low shrinkage component of the mixed composite multifilament yarn or spun yarn, fibers or filaments having a smaller single fiber denier than that of the fiber used in the high shrinkage component are preferably used, to obtain a fabric having a soft feeling and spun like outer configuration and to prevent a fastening effect and dust accumulation.

Note, the yarn construction of the latent looped yarn explained heretofore can be applied to a fabric having such a high yarn density.

The most preferable yarn construction of the latent looped yarn of the present invention is such that the multifilament having a high shrinkage ratio is preferably arranged in a core portion of the latent looped yarn and the multifilament having a low shrinkage ratio or normal shrinkage ratio is preferably arranged in a sheath portion thereof, although the yarn construction of this invention is not restricted to this construction.

The manufacturing method for obtaining the latent looped yarn explained above can be also applied to the method for making a fabric having a high density as described above.

As described above, the latent looped yarn of this invention has latent opened loops and closed loops therein when produced and the number of loops C projected from the surface of the yarn is extremely small. Accordingly, the bulkness of this yarn, per se, is very low and the surface of the yarn is comparatively smooth, and therefore, the yarn running friction thereof at a device provided in this process is very small.

Especially, when this yarn is used as a warp yarn of a fabric, the running ability of the yarn in the head and the reed is excellent, and there is no possibility of an entanglement of the loops of adjacent warps, or an incomplete shedding at a loom. Therefore, this yarn can be used as a warp of the fabric.

Further, when a dyeing and finishing treatment is applied to the fabric after the weaving process, a high density and high bulky fabric can be obtained by treating the fabric with a heat treatment (utilizing dry heat, wet heat or steam heat, for example) at a high temperature in a tension free condition alone, or accompanied by a dying treatment, causing the latent opened loops and closed loops of the latent looped yarn to be revealed.

EXAMPLE 5

In the process shown in FIG. 1, a bright polyester multifilament yarn, 50D-24F, having a circular cross sectional shape and having a shrinkage ratio in hot water of 20% was used as a component yarn, preferably as a core yarn, and a bright polyester multifilament yarn, 50D-72F, having a circular cross sectional shape and having a shrinkage ratio in hot water of 7. 5% was used as a component yarn, preferably as a sheath provided with a eddy current nozzle at an overfeed ratio of the core yarn of +9% and an overfeed ratio of the sheath yarn of +15% and treated by a texturizing treatment at an air feed volume of 90 N 1/min.

Subsequently, the thus treated yarn was wound up on a package while being stretched between the first taking up roller and the second taking up roller, at an underfeed ratio of −5.4%.

The yarn characteristics thus obtained are as follows.

| | |
|---|---|
| Total yarn denier | 106 D |
| Shrinkage ratio of the yarn | 17.8% |
| Number of loops before the heat treatment | |
| LOOP A | 447 ends/m |
| LOOP B | 125 ends/m |
| LOOP C | 1 ends/m |
| Number of loops after the heat treatment | |
| LOOP A | 438 ends/m |
| LOOP B | 390 ends/m |
| LOOP C | 168 ends/m |

Thereafter, the thus obtained latent looped yarn was used as the warp and weft yarns to make a plane fabric, utilizing a water jet loom with a warp yarn density of 85 ends/inch (the cover factor of the warp yarn was 850) and a weft yarn density of 78 ends/inch.

The grey fabric was then given the following sequence of treatments; a relaxed treatment, an intermediate setting treatment, an alkali weight loss treatment (5%), a dyeing treatment, and a finishing treatment, and a high density fabric having a warp yarn density of 117 ends/inch (the cover factor of the warp yarn was 1170) and a weft yarn density of 100 ends/inch was obtained.

The cover factor referred to in the present invention is found by the following equation.

Cover Factor = denier of the warp yarn (d) X density (ends/inch)

The thus obtained fabric had opened loops and closed loops existing in a mixed state on the surface of the fabric, and had a superior soft touch and spunlike feeling similar to a fabric made of a spun yarn, because the surface of the fabric of the present invention was covered with fine and micronized loops, and further, the fabric of the present invention had a good stiffness because of the fabric had a high yarn density.

EXAMPLE 6

In the process shown in FIG. 1, a bright polyester multifilament yarn, 30D-12F, having a circular cross sectional shape and having a shrinkage ratio in hot water of 20% was used as a component yarn, preferably as a core yarn, and a bright polyester multifilament yarn, 30D-48F, having a circular cross sectional shape and having a shrinkage ratio in hot water of 7. 5% was used as a component yarn, preferably as a sheath yarn, and these yarns were supplied to a texturing zone provided with an eddy current nozzle at an overfeed ratio of the core yarn of +9% and an overfeed ratio of the sheath yarn of +15%, and were treated by a texturizing treatment with having an air feed volume of 90 N 1/min.

Subsequently, the thus treated yarn was wound up on a package while being stretched between the first taking up roller and the second taking up roller, at an underfeed ratio of −5.4%.

The yarn characteristics thus obtained are as follows.

| | |
|---|---|
| Total yarn denier | 63 D |
| Shrinkage ratio of the yarn | 18.4% |
| Number of loops before the heat treatment | |
| LOOP A | 332 ends/m |
| LOOP B | 72 ends/m |
| LOOP C | 1 end/m |
| Number of loops after the heat treatment | |
| LOOP A | 416 ends/m |
| LOOP B | 330 ends/m |
| LOOP C | 88 ends/m |

Thereafter, the thus obtained latent looped yarn was used as the warp and weft yarns to make a plane fabric, utilizing a water jet loom, with a warp yarn density of 142 ends/inch (the cover factor of the warp yarn was 1100) and a weft yarn density of The grey fabric was then treated by the following sequence of treatments; a relaxed treatment, an intermediate setting treatment, an alkali weight loss treatment (5%), a dyeing treatment, and a finishing treatment, and a high density fabric having a warp yarn was 1370) and a weft yarn density of 135 ends/inch, was obtained.

The thus obtained fabric had opened loops and closed loops existing in a mixed state on the surface of the fabric, and had a superior soft touch and spunlike feeling similar to a fabric made of the spun yarn, because the surface of the fabric of the present invention was covered with fine and micronized loops, and further, the fabric of the present invention had a good stiffness because this fabric had a high yarn density.

The fabric of the present invention has a high density, although having a stiffness based upon the bulkiness of the yarn, and simultaneously, has an improved water proof characteristic, and therefore, when a water repellent finish is applied to the fabric after the dyeing treatment, the fabric is suitable for use in sporting products, especially ski products.

Next, when the high density fabric of this invention having a spunlike feeling is further developed, another spunlike fabric having a high density, which is suitable for a coat or an outer garment for sports, which especially requires, in particular, a function such as a waterproofing or wind breaking characteristic, can be obtained.

Heretofore, as the fabrics for such a purpose, a high density fabric utilizing conjugated synthetic multifilament yarns having component filaments of which are dividable and separable, as shown in Japanese Opened Patent Publication 57-117647, and a fabric having a water proofness, moisture permeability, and water repellency, which is produced in such a way that first a high density fabric is woven utilizing a mixed multifilament yarn comprising a multifilament yarn as a high shrinkage component and a multifilament yarn consisting of ultra fine multifilaments as a low shrinkage component, and the water repellent treatment is applied to the fabric, as shown in Japanese Opened Patent Publication 59-204941, 60-394385, have been proposed.

These fabrics are given a function such as waterproofness and moisture permeability by keeping the interspaces between each filament in a micron order, by arranging the filaments in such a way that the number of filaments per unit area of the high density fabric is set to the extreme upper limit thereof.

Accordingly, in the construction of said fabric, the density of the filaments is increased in the condition whereby the filaments are arranged as parallel to each other as possible. This fabric has a greasy feeling inherent to the ultra fine synthetic filaments, and has a drawback such that this fabric does not have a good natural unevenness, compared with the fabric made of spun yarns, from the visual point of view.

According to the fabric of the present invention as explained hereunder, the technical problems described above can be overcome and a spunlike high density fabric, having not only functions such as waterproofness and moisture permeability but also a spunlike feeling and outer look, can be provided.

The fabric mentioned above has a construction such that the latent looped yarn described above is used as a warp yarn and a synthetic multifilament yarn, each component filament of which having a flat cross sectional shape, is used as a weft yarn and the total cover factor of the warp yarn and the weft yarn is from 1800 to 3500.

In this invention, as a looped yarn for the warp yarn, the latent looped yarn is used and said latent looped yarn is preferably a composite yarn having a sheath-core type yarn configuration, wherein the synthetic multifilament yarn used as the core side portion of the composite yarn has a relatively large denier of a single component filament thereof, and the synthetic multifilament yarn used as the sheath of the composite yarn has a relatively small denier of a single component filament thereof. Note, in this invention, the yarn construction is not restricted to the sheath-core type composite yarn.

Generally speaking, in a high density fabric, the stiffness thereof is high and the handling thereof is coarse because movement of the yarns relative to each other, inside the high density fabric, is restricted.

Accordingly, preferably an ultra fine multifilament yarn having a denier of the component filament of 0.05–1.3d is used as the yarn for the sheath portion of the composite yarn, and further, preferably the multifilament yarn having a denier of the component filament of 0.1–15d, is used as the yarn of the core portion thereof, and the voluminosity and resiliency can be given to the fabric.

Both the yarn construction and the yarn making method mentioned above can be applied to the yarn construction of the latent looped yarn and the manufacturing method thereof in this embodiment. On the other hand, a flat ratio of the filaments having a flat cross sectional shape consisting of the synthetic multifilament, used as a weft yarn in this embodiment, is preferably 2.0–6.0.

When the flat ratio is less than 2.0, the waterproofness or wind breakability, which is provided mainly by the flatness of the filament, will be small, but on the other hand, when the flat ratio is more than 6.0, the luster of the fabric will be increased and the spunlike feeling or outer configuration thereof caused by the warp yarn will be reduced. Accordingly, the preferable condition of the flat ratio is from 2.0 to 6.0.

Figure 3:
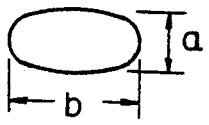
FIG. 3 is a cross sectional view of a filament having a flat shape in cross section, as used in the present invention.

The flat ratio of this embodiment is represented by b/a, wherein a refers to a long side width and b refers to a short side width in the cross sectional shape shown in FIG. 3, respectively.

As the multifilament having a flat cross sectional shape is naturally accurately arranged in a certain direction in the fabric, the space provided between the adjacent yarns can be reduced and made extremely narrow, enabling an increase of the waterproofness and moisture permeability of the fabric. In a fabric woven using hundred percent of multifilaments having a flat cross sectional shape, problems arise of a smooth feeling and strong luster caused by the light reflected at the surface of the fabric, although these problems can be overcome in the present invention because of the resistance of said closed loops and opened loop on the surface of the fabric, causing a change of such a smoothness and strong luster.

Further, when a multifilament having a flat cross sectional shape is used in a weaving process, preferably the filaments are not subjected to a heat treatment such as a false twisting process, and post twisting is avoided as much as possible, in order to actuate the shrinkage characteristic of the filaments. Namely, even when such a yarn is used as a warp yarn, the post twisting number should be less than about 300 turns/m.

As the method for obtaining a high shrinkage component multifilament yarn and a low shrinkage component multifilament yarn of the latent looped yarn, a direct spinning and drawing method, a filament mixing method in which the high shrinkage component multifilament yarns and the low shrinkage component multifilament yarns are respectively spun previously and then mixed, or a filament mixing method in which two high shrinkage component multifilament yarns are spun and then one of the yarns is treated with heat utilizing a hot plate to make a low shrinkage multifilament yarn which is thereafter is mixed with the high shrinkage multifilament yarn not subjected to the heat treatment, can be used in this invention.

An example of the high density fabric mentioned above will be now explained.

EXAMPLE 7

In the process shown FIG. 1, a bright polyester multifilament yarn, 30D–12F, having a circular cross sectional shape and having a shrinkage ratio in hot water of 20% was used as a component yarn, preferably as a core portion, and a bright polyester multifilament yarn, 30D–48F, having a circular cross sectional shape and having a shrinkage ratio in hot water of 8% was used as a component yarn, preferably as a sheath portion, and these yarns were supplied to a texturing zone provided with a eddy current nozzle at an over feed ratio of the core side yarn of +9% and an overfeed ratio of the sheath side yarn of +15% and treated by a texturizing treatment having an air feed volume of 90 N 1/min at a feed ratio of the first to the second taking up roller of −5.4%.

The thus obtained looped yarn had a total yarn denier of 63D and shrinkage ratio in hot water of 18.4%, and the number of loops before the heat treatment was such that the loops A were 332 ends/m, the loops B were 72 ends/m, and the loops C were 1 end/m, while the number thereof after the heat treatment, i.e., a shrinkage treatment in hot water under a shrink free condition, was such that the loops A were 416 ends/m, the loops B were 330 ends/m, and the loops C were 88 ends/m, and these latent looped yarns were used as the warp yarns.

Further, a bright polyester multifilament, 50D-24F, each component filament of which had a flat cross sectional shape and a flat ratio of 4.5 and which had a total shrinkage in hot water of 15.7%, comprised a multifilament yarn, 25D-12F, having a shrinkage ratio in hot water of 16.5% and a multifilament yarn, 25D-12F, having a shrinkage ratio in hot water of 10.3%, and spun by a direct spinning and drawing method, was used as the weft yarns. Then a fabric having a warp yarn density of 114 ends/inch, and a weft yarn density of 120 ends/inch, and having a total cover factor as a sum of the cover factors of the warp and weft of 1730, was woven. The method for measuring the cover factor as described above can be also applied to this embodiment.

Thereafter, the thus obtained fabric was dyed in a conventional relaxing and dyeing process and then finished by a finishing process with a water repellent agent.

The thus treated final fabric had a warp yarn density of 156 ends/inch and a weft yarn density of 146 ends/inch, and had a total cover factor as a sum up the cover factors of the warp and weft yarns, of 2240, and moreover, the fabric had functional features such as a waterproof pressure of 560 mm, a water repellency of 90 points, and a moisture permeability of 8200 $g/cm^2/24$ Hr, and this was a superior fabric having a high density and spunlike feeling both in handling and external configuration which can not be obtained in a fabric made of a textured yarn such as "TASLAN".

In the example above, the latent looped yarn of the present invention is mainly used as the warp yarns, although the latent looped yarn of the present invention need not be used only as the warp yarns but can be also used as both the weft yarn and the warp yarn, as well as the weft yarn.

Next, in this invention, a spunlike high density fabric having a softer feeling than that of the fabric obtained in the example above was obtained.

This fabric has the following fabric construction. Namely, a mixed fabric having a high density, in which mixed composite multifilament yarns consisting of at least a synthetic multifilament yarn having a shrinking function and having fine opened loops and closed loops on a surface thereof, were used as warp yarns and spun yarns were used as weft yarns or warp yarns, and was further characterized in that a total cover factor of the warp yarns and the weft yarns thereof was from 2000 to 3500.

In this embodiment, a fabric having a high yarn density, which heretofore could not be produced by utilizing spun yarns, can be obtained, and further, a fabric having a good handling never seen heretofore and a spunlike external configuration caused by the fluffs of the spun yarns and the opened loops and the closed loops of the multifilaments, which are joined together, was obtained.

In this embodiment, the latent looped yarns may be used as a warp yarn or a weft yarn or as both.

The yarn construction and the method for producing the same, as mentioned above, can be applied to this embodiment. But, as the latent looped yarn used in this embodiment, the preferred yarn construction is the same construction of the latent looped yarn used as a warp yarn explained in the previous embodiment.

In this embodiment, when the latent looped yarn is used as a warp yarn and the spun yarn is used as a weft yarn, a fabric having an extremely high yarn density, which can not be realized by using the conventional looped yarn, can be produced, because the latent looped yarn has a straight configuration which is not recognized as a looped yarn at a glance, and is completely different from the looped yarn obtained by a conventional eddy current treatment.

Accordingly, in this embodiment, the fabric may be woven with as high a warp yarn density as possible, and with the spun yarns as a weft yarn at a normal or higher density, and then thus woven the fabric is shrunk in the warp direction by a shrinking treatment carried out in later process, such as a dyeing process, to make the fabric into a fabric having a high weft yarn density, and simultaneously, to make a fabric having a high density and superior spun like effect both in feeling and external configuration without loosing the handling effect of the spun yarns.

The latent looped yarn may be used with post twisting. On the other hand, as the spun yarn, a spun yarn made of natural fibers such as cotton, wool, linen or silk, or made of the synthetic fibers such as polyester, nylon or acryl, or a mixed spun yarn consisting of at least two kinds of fiber selected from any of those mentioned above, can be used.

But, in consideration of the count number of the spun yarn, a fine yarn count such as more than 30S in a cotton count system is desirable, in order to obtain a thin fabric.

Also, in this embodiment, preferably the spun yarn is used as a single yarn.

Moreover, in the case of a high density fabric in which the spun yarns are used as warp yarns, by using the latent looped fabric having a shrinkage ratio in hot water of more than 10%, preferably more than 15%, and having closed and opened loops, as the weft yarns, the fabric can be woven with a comparatively coarser yarn density than the desired yarn density by calculating the increment of the density caused by the shrinkage of the weft yarn.

When the fabric is treated thereafter in the dyeing process, to bulk up the fabric, the fabric can be reduced to a fabric having a further high yarn density by attaining a bulkiness and high density thereof, and simultaneously, incrementing the picking density of the weft yarn.

EXAMPLE 8

As a warp yarn, a single polyester 100% spun yarn having cotton count of 60S is used, and as a weft yarn, a latent looped yarn made by the process described hereunder is used.

Namely, in the process as shown in FIG. 1, a bright polyester multifilament yarn, 30D-12F, having a circular cross sectional shape and having a shrinkage ratio in hot water of 20% is used as a component yarn, preferably as a core portion, and a bright polyester multifilament yarn, 30D-48F, having a circular cross sectional shape and having a shrinkage ratio in hot water of 7.5% is used as a component yarn, preferably as a sheath portion, and these yarns are supplied to a texturing zone provided with an eddy current nozzle at an overfeed ratio of the core side yarn of +9% and an overfeed ratio of the sheath side yarn of +15% and are treated by a texturizing treatment having an air feed volume of 90 N 1/min at a feed ratio of the first to the second taking up roller of −5.4%.

The thus obtained looped yarn has a total yarn denier of 63D and a shrinkage ratio in hot water of 18.4% and the number of loops before the heat treatment is such that the loops A are 332 ends/m, the loops B are 72 ends/m, and the loop C is 1 end/m, and the number thereof after the heat treatment, i.e., a shrinkage treatment in hot water under a shrink free condition, is such that the loops A are 416 ends/m, the loops B are 330 ends/m, and the loops C are 88 ends/m.

Then a plane fabric was woven with the warp yarn and the weft yarn mentioned above, utilizing a rapier loom, and thereafter, the gray fabric thus obtained was treated by a usual relaxing operation and dyeing operation utilizing a jet dying machine.

The fabric thus obtained was finished with a water repellent treatment, and a calendering treatment on the back surface of the fabric, after being treated with a setting treatment for finishing, and the thus finished final product had improved functions due to an increment of the warp yarn density and a desirable finishing effect having an excellent feeling and external configuration which can not be obtained by the conventional method, as indicated below.

Further, the weaving ability of the fabric was excellent and problem-free.

In the comparative embodiment described below, the fabric was woven with 100% single cotton spun yarns having a cotton count of 80S (combed cotton yarn).

| | Example | Comparative Example |
|---|---|---|
| Warp yarn density × weft yarn density of the gray fabric | 114 × 110 | 146 × 131 |
| (Cover factor) | (1920) | (2257) |
| Warp yarn density × weft yarn density of the fabric after dyeing | 152 × 120 | 157 × 135 |
| (Cover factor) | (2350) | (23280) |
| Water proof pressure (mm) | 430 | 210 |
| Moisture permeability (g/cm$^2$/24 hr) | 8450 | 8810 |

EXAMPLE 9

In this Example, a plane fabric was woven utilizing the latent looped yarn used as a weft yarn in Example 8 as a warp yarn, and 100% of single cotton spun yarns having a cotton count of 80S (combed cotton yarn) as a weft yarn, by a rapier loom.

Then the thus obtained fabric was treated by a dyeing process in which a relaxing treatment, an intermediate setting treatment, a dyeing and finishing treatment, a water repellent treatment, and a calendering treatment on the back side of the fabric were applied to the fabric, in this order.

The thus obtained fabric had a similar feeling and external configuration as the fabric made of 100% spun yarns, and superior functions, as described hereunder.

| | |
|---|---|
| Warp yarn density × weft yarn density of the gray fabric | 176 ends/in × 95 ends/in |
| (Cover factor) | (2168) |
| Warp yarn density × weft yarn density of the fabric after dyeing | 183 ends/in × 118 ends/in |
| (Cover factor) | (2410) |
| Water proof pressure (mm) | 410 |
| Moisture permeability (g/cm$^2$/24 hr) | 8600 |

The cover factor used in this embodiment is obtained by the following equation.

$$\text{Cover factor} = [\text{warp yarn density (ends/inch)} + \text{weft yarn density (ends/inch)}] \times \sqrt{D}$$

wherein, D is a denier of the multifilament, and when a spun yarn is used, the cotton count number S is converted into denier D by the equation: 5315/cotton count number.

As a spun like fabric, a fabric made of a high quality cotton, especially made of a spun yarn having a cotton count number of more than 60S, the yarn of which consists of cotton fibers having a super high staple length, is required, and thus many attempts to make a fabric having a similar handling to that of a fabric utilizing synthetic fibers have been made.

The handling or feel thereof reached a high level, due to improvements in the spinning technology and the yarn texturizing technology, especially in the attenuation of a filament denier to an ultra fine denier, or producing an alternating twisted false twisted yarn and a sheath core type false twisted composite yarn or the like.

Nevertheless, the fluff feeling caused by cotton fibers, from the visual point of view, could not be realized in such a manner heretofore.

To attain such an object, a fabric made of a looped yarn produced by an eddy current treatment has been proposed and developed, although it is difficult for this fabric, even when having a fluff feeling of cotton fibers caused by the surface effect of the loops, to be given a special bulkiness caused by the cotton having a super high fiber length, a smooth surface touch, and a stiffness caused by the high yarn density.

But when the latent looped yarn of this invention is used in the fabric, then such a fabric having a special feeling of cotton having a super high fiber length, in addition to a smooth surface touch, a fluff feeling, and a stiffness caused by the high yarn density, can be obtained.

Such a fabric can be produced in the manner described hereunder.

Namely, the method of manufacturing a fabric having a spun like feeling resembling a fabric made of super high length cotton fibers, in which the fabric is woven with mixed composite multifilament yarns made of synthetic multifilaments having a total denier of less than 90d, wherein the composite yarn consists of a filament A having a shrinkage ratio in hot water of more than 12% and a denier of a component filament thereof is more than 1.5d, and a total denier thereof is less than 60d, and a filament B having a shrinkage ratio in hot water of less than 10% and a denier of a component filament thereof is less than 1.0d, and a total denier thereof is less than 60d, and the composite yarn is further characterized by having more than 300 ends/m of the loop A, more than 50 ends/m of the loop B, and less than 10 ends/m of the loop C, each of the loop A, loop B, and loop C being defined hereunder, and thereafter a shrinking treatment is applied to the fabric to cause a differential shrinkage between the filament A and filament B, which results in a projection of the opened loops and closed loops of the filament B on the surface of the fabric, wherein each of the loop A, loop B and loop C is measured by the measuring method described heretofore.

As the mixed composite yarn used in this embodiment, the latent looped yarn explained heretofore can be used, and the yarn construction and the manufacturing method thereof are as the same as that described above.

The multifilament used in this embodiment may be any kind of synthetic multifilament, but is especially a polyester multifilament.

A multifilament having a high shrinkage ratio and the multifilament having a low shrinkage ratio may be arranged in the form of a sheath core type configuration in the latent looped yarn or arranged in a side by side configuration therein.

Further, in this embodiment, the latent looped yarn can be used as the warp yarn or as both the warp and the weft yarns.

When the latent looped yarn is used only as the warp yarn, the cover factor of the warp yarn in a gray fabric is preferably more than 800, more preferably, more than 1100.

When the latent looped yarn is used as both the warp and the weft yarns, the total cover factor as a sum of the cover factors of the warp yarn and the weft yarn in the gray fabric, is 1500–2700, more preferably 1800–2500.

Desirably, the warp yarn of this embodiment is twisted more than 300 T/m, in order to obtain a handling and the external configuration closer to the spun like feeling provided by the fibers having a super high length.

The embodiment described above will be now explained in more detail.

To develop the fluff feeling of the fibers having a super high length, the use of the latent looped yarn of the present invention is suitable, and to obtain the smooth surface touch of the fibers having a super high length, it is effective to use a composite multifilament having a total denier of less than 90D, more preferably less than 70D, comprising the component filaments used as the sheath yarn having a denier of less than 1.0d, preferably less than 0.7d, according to the present invention.

The fibers having a super high length, as used in this embodiment, are referred to as Egyptian cotton and the Sea Island cotton or the like having a comparatively high fiber length, and a spun yarn made of such cotton fibers may have a cotton yarn count of more than 60S, more preferably more than 80S, and a thickness thereof of 10 μ–14 μ.

According to investigation by the inventors into a polyester composite yarn having opened loops and closed loops on the surface thereof caused by the eddy current treatment, when the single filament denier is more than 10 μ, i.e., the thickness thereof is more than 1d, the yarn was stiff and the effect of the fabric obtained by the yarn was not good.

On the other hand, when a single filament denier is less than 1d, a fabric having smooth surface touch can be obtained, and especially, when the denier thereof is less than 0.7d (less than 8.5 μ), an excellent effect can be obtained.

This is considered to be because, when using a cotton fiber, the fluff thereof are projected alone from the surface of the spun yarn, one by one, and on the other hand, in the polyester composite yarn, the fluff consists of a loop and thus the stiffness thereof is double that of each filament.

Next, to obtain a fabric made of a spun yarn comprising fibers having a super high length, stiffness, and a high density, the fabric must be woven at least with a high warp yarn density, even though it is difficult to so weave a fabric with a conventional composite looped yarn produced by a usual eddy current treatment because the loops of the warp yarns binder the shedding operation.

Therefore, in this embodiment, a process is adopted whereby, during the weaving, the loops of the warp yarn are kept small, i.e., in a latent condition, and thereafter, in the dyeing and finishing process after the weaving process, the yarn is shrunk to develop the loops on the surface of the fabric and, simultaneously, to reduce the fabric to one having a high density.

Next, an Example of the embodiment described above will be explained.

EXAMPLE 10

In the process shown in FIG. 1, a polyester multifilament yarn, 20D–8F, having a shrinkage ratio in hot water of 20% is used as a core yarn and a polyester multifilament yarn, 20D–48F, having a shrinkage ratio in hot water of 8% is used as a sheath yarn, and these yarns are supplied to a texturing zone provided with an eddy current nozzle at an overfeed ratio of the core yarn of +9% and an overfeed ratio of the sheath yarn of +15%, and are treated by a texturizing treatment having an air feed volume of 90 N 1/min.

Subsequently, the thus treated yarn is wound up on a package while being stretched between the first taking up roller and the second taking up roller, at an underfeed ratio of −5.4%.

The yarn characteristics thus obtained are shown hereunder.

| | |
|---|---|
| Total yarn denier | 43 D |
| Shrinkage ratio of the yarn | 19.2% |
| Number of loops before the heat treatment | |
| LOOP A | 330 ends/m |
| LOOP B | 71 ends/m |
| LOOP C | 1 end/m |
| Number of the loops after the heat treatment | |
| LOOP A | 441 ends/m |
| LOOP B | 328 ends/m |
| LOOP C | 86 ends/m |

Thereafter, the thus obtained latent looped yarns were used as the warp and weft yarns to make a plane fabric with a warp yarn density of 180 ends/inch and a weft yarn density of 130 ends/inch, and then the resulting grey fabric was treated by a relaxing treatment at 98° C. and a dyeing treatment at 130° C.

Accordingly, a high density fabric having a warp yarn density of 225 ends/inch and a weft yarn density of 156 ends/inch, and having fine loops developed on the surface thereof, and further, having a smooth surface touch and bulkiness similar to those obtained by cotton fibers having a super high fiber length, and a stiffness caused by the high density, was obtained.

We claim:

1. A looped composite yarn consisting essentially of at least one synthetic component multifilament yarn having a high shrinkage ratio and at least one synthetic component multifilament yarn having a low shrinkage ratio, and having fine opened and closed loops on the surface thereof, said looped yarn having the capability whereby the total number and size of said closed and opened loops thereof can be increased by thermally treating the yarn while it is free of tension, said fine loops retained on said composite yarn before said thermal treatment being classified as loops A, comprising more than 300 ends/m, loops B, comprising more than 45 ends/m, and loops C, comprising less than 10 ends/m and wherein each of said loops A, B and C is defined in such a manner that when each loop is measured under conditions of a yarn speed of 50 m/min and a yarn running tension of 0.1 g/d, loops projecting more than 0.15 mm from the yarn surface are defined as said loops A, loops projecting more than 0.35 mm from the yarn surface are defined as said loops B and loops projecting more than 0.6 mm from the yarn surface are defined as said loops C and at least the number of loops B is more than 1.5 times that of said looped yarn before the heat treatment and the number of loops C is more than 50 ends/m after said looped yarn is subjected to said thermal treatment, wherein said shrinkage in hot water of the component filament of said multifilament yarn having a high shrinkage, is more than 10% and the difference in shrinkage in hot water between said component filament having said high shrinkage and said component filament of said multifilament yarn having low shrinkage is more than 5% and wherein the component filament of said multifilament yarn having high shrinkage has a denier of 0.1–15 and the component filament of said multifilament yarn having low shrinkage has a denier of 0.05–1.3.

2. The looped yarn of claim 1, wherein said yarn is thermally treated with hot water at 98° C. for ten minutes under a tension free condition and subsequently dried.

3. The looped yarn according to claim 1, wherein shrinkage in not water of said looped yarn is at least 10%.

* * * * *